United States Patent [19]

Rakoczy

[11] 3,998,168

[45] Dec. 21, 1976

[54] IMPACT PANEL SEPARATOR LOCKING DEVICE

[76] Inventor: Paul J. Rakoczy, 28810 Village Lane, Farmington Hills, Mich. 48024

[22] Filed: June 6, 1975

[21] Appl. No.: 584,279

[52] U.S. Cl. ..... 105/490; D8/109; D8/117; 105/367; 105/486

[51] Int. Cl.[2] ..... B60P 7/14; B60P 7/16; B61D 45/00; B61D 49/00

[58] Field of Search ..... 105/367, 486, 491, 490; D8/109, 117

[56] References Cited

UNITED STATES PATENTS

| | | | |
|---|---|---|---|
| 3,580,186 | 5/1971 | Pierce | 105/367 |
| 3,581,675 | 9/1969 | Kauffman | 105/367 |
| 3,779,173 | 12/1973 | Pierce | 105/367 |

FOREIGN PATENTS OR APPLICATIONS

| | | | |
|---|---|---|---|
| 880,060 | 9/1971 | Canada | 105/491 |

*Primary Examiner*—Robert G. Sheridan
*Assistant Examiner*—Howard Beltran
*Attorney, Agent, or Firm*—Basile, Weintraub and VanOphem

[57] ABSTRACT

An adjustable locking device for a railroad car rack separator, such as those used to separate racks containing automotive sheet metal stampings, such as fenders. The device comprises a rotatable plate having a central keyway which plate after rotation is shiftable along a notched bar to be positioned in a notch and after further rotation lockingly abuts the rack.

9 Claims, 5 Drawing Figures

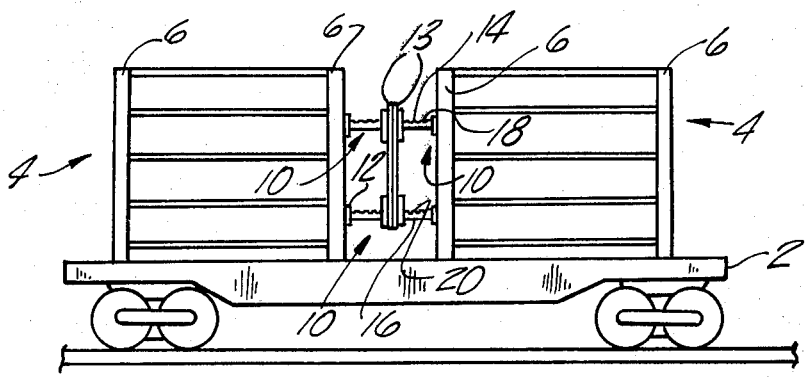
Fig-1
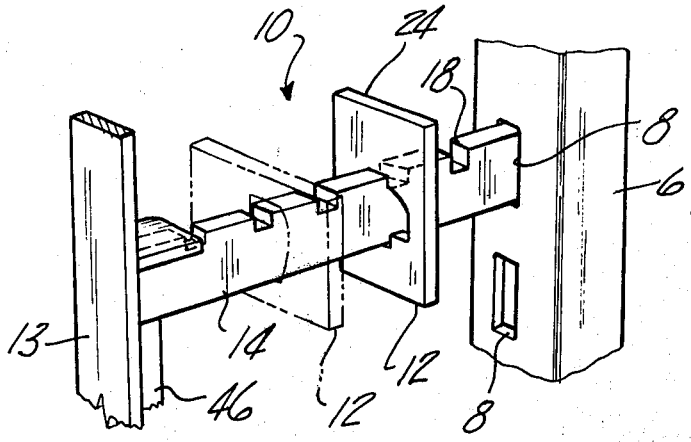
Fig-2
Fig-3
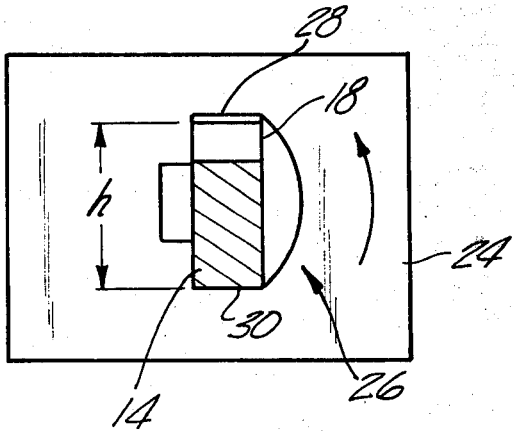
Fig-4
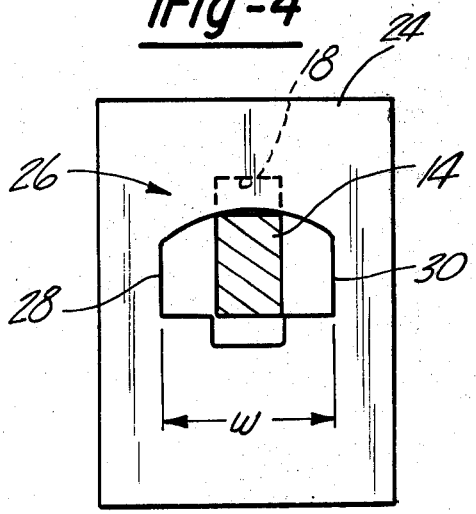
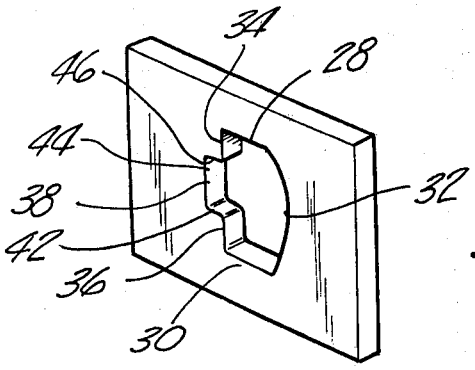
Fig-5

IMPACT PANEL SEPARATOR LOCKING DEVICE

BACKGROUND OF THE INVENTION

1. Field of the Invention

The present invention pertains to locking devices. More particularly, the present invention pertains to rack separator locking devices. Even more particularly, the present invention concerns locking devices for railroad car rack separators.

2. Prior Art

The use of railroad cars to transport vehicles and vehicular parts, such as fenders, is well known. With respect to vehicle fenders, they are usually mounted on a plurality of adjacent racks. The racks which hold the fenders are, generally, loosely mounted in the railroad car. Because of the swaying encountered in the operation and running of a railroad car, the fenders disposed on adjacent racks crash together. This results in the fenders being damaged with the resulting economic loss. This is directly attributable to the momentum transferred to individual racks.

To alleviate this problem, the prior art has taught removable impact separators with adjustable locking devices which fix a distance between adjacent racks. However, presently known locking devices are expensive to manufacture. Generally, they are three piece assemblies which, upon impacting and rusting due to weathering, become frozen or non-functional and, thus, are not readily removed from their associated separators when unloading a railroad car.

The present invention, on the other hand, provides a universal rack separator locking device of reduced cost of manufacture and which is readily positioned on, as well as readily removed from its associated rack separator. The locking device hereof remains functional whether impacted or rusted.

SUMMARY OF THE INVENTION

The present invention provides a locking device for an impact panel separator, such as those associated with railroad mounting racks and in particular, those used in the transport of sheet metal stampings, such as vehicular fenders and the like.

The separator locking device hereof generally comprises a plate having a centrally disposed keyway formed therethrough.

The keyway is configured such that it includes a pair of spaced apart linear sidewalls, an arcuate top wall and a linear bottom wall. A recess is formed in the bottom wall. The keyway has a width slightly greater than the height of the separator.

For a more complete understanding of the present invention reference is made to the following detailed description and accompanying drawing. In the drawing, like reference characters refer to like parts throughout the several views in which:

BRIEF DESCRIPTION OF THE DRAWING

FIG. 1 is a side elevational view of a railroad car having racks disposed thereon, the racks being separated by the impact panel separators of the present invention;

FIG. 2 is a perspective, broken view partly in phantom, of an impact panel separator and locking device of the present invention;

FIG. 3 is a front elevational view of the locking device of the present invention in a mounting position;

FIG. 4 is a front elevational view of the locking device of the present invention in a locking position, and FIG. 5 is a perspective view of the locking device of the present invention.

DESCRIPTION OF THE PREFERRED EMBODIMENT

Referring to the drawing, and in particular FIGS. 1 and 2, as is known to those skilled in the art to which the invention pertains, sheet metal stampings, such as vehicle fenders, are transported in railroad cars 2 on racks 4. Generally, a plurality of racks are mounted, in linear fashion, on the railroad car. Pairs of racks 4 which are spaced apart and parallel to each other are used to mount fenders. The racks generally comprise rectangular frameworks having a plurality of upstanding posts 6. The posts, which are tubular in construction, are provided with a plurality of apertures 8 which slidingly receive the impact panel separators 10 of the present invention, and which are described in detail subsequently. The structure of the racks, per se, however, does not form a part of the present invention, their structure being known to the skilled artisan.

Still referring to FIGS. 1 and 2, there is depicted therein the impact panel separator 10 and a locking device 12 therefor.

The separator 10 generally comprises a support plate 13 which is adapted to abut against an adjacent support plate 13 associated with a separator 16 for an adjacent rack.

The separator 10, also, includes a pair of linear parallel spaced apart members 14, 16, respectively. The members 14, 16 project outwardly from the support plate 13 and are substantially perpendicular thereto. The members 14, 16 are secured to the plate by welding or the like. The members 14, 16 slide into the apertures 8 provided in the posts 6 of the rack heretofore described.

The depth of insertion of the members 14, 16 into the post apertures is a function of the degree of insertion of the adjacent separator 10, such that two adjacent support plates will normally abut each other in a rest position, as shown in FIG. 1.

Each member 14 or 16 is provided with a plurality of notches 18, 20, respectively. The notches are equidistantly spaced apart along the extent of the associated member 14 or 16. The notches are, generally, rectangularly shaped and are uniform in size. Any one notch thereof is adapted to receive the locking device of the present invention and, which is, generally, indicated at 12.

The locking device 12 hereof, as clearly shown in FIGS. 2–5, generally, comprises a plate member 24 having a centrally disposed keyway 26 formed therethrough. The plate 24 is substantially planar and has a thickness slightly less than that of the width of any notch 18 or 20. By so dimensioning the plate 24 it is easily inserted and removed from any notch, when so desired. Moreover, the possibility of unwanted dislodgement of the plate is practically nil.

The keyway 26 is configured such that it is defined by a pair of spaced apart, parallel side walls 28, 30. An arcuate top wall 32 interconnects the upper termini of the side walls 28, 30. The base of the keyway is defined by a pair of opposed linear sections 34, 36 and a central recess 38. The recess is defined by a pair of opposite walls 40, 42. The walls 40, 42 of the recess depend downwardly from and substantially perpendicular to their associated linear sections 34, 36. A substantially linear wall 44 interconnects the lower termini of the walls 40, 42 to thereby define the recess 38.

With respect to the configuration of the keyway, it is critical hereto that the distance between the top of the arcuate wall 32 and the linear sections 34, 36 be less than the height h of the linear members 14 or 16. Also, it is critical hereto that the distance w between the walls 28, 30 be slightly greater than the height h of the linear members 14, 16.

Referring specifically now to FIGS. 2, 3 and 4, there is depicted therein the deployment of the device 22 hereof. As shown in FIGS. 3 and 4, the device is rotated such that the plate 24 is translated along the linear member 14 or 16, as shown in phantom. This is achieved by inserting the member 14 or 16 into the keyway such that the side walls 28 and 30 overlie and underlie the height of the member 14 or 16. When reaching the desired notch 18, the plate 24 is first dropped into the notch (FIG. 3) and, then, rotated to the position shown in FIG. 4. Because of the dimensioning of the plate proper and the keyway, the plate drops into the notch such that the base thereof engages the arcuate top wall. Furthermore, because of the dimensioning of the keyway, and by the force of gravity the device 12 cannot be removed from the notch without reversing the rotating motions.

In utilizing the locking device, it is first translated over its associated linear member. Then, the linear members are inserted and slid into the apertures 8 of the rack posts 6 to the desired position. Next, the locking device is rotated into the first notch available between the post and the support plate of the separator, as shown in FIG. 1.

In forming the locking device, the keyway can be punched out on a punch press or be formed by any other suitable mode.

Referring again to FIG. 2, associated with each linear member of the separator 10, is a support plate strengthener 46 (only one of which is shown). The strengtheners 46 envelope their associated linear members 14, 16, as shown proximate the junction thereof with the support plate 13. The strengtheners are secured to the support plate such as by welding or the like.

The strengtheners function to dissipate some of the forces transferred to the support plate and linear members when adjacent separators crash together due to the motion of the railroad car.

It is to be appreciated that the locking device hereof holds the separator in position thereby reducing the hazards of stacks of fenders crashing together. Because the separators are locked in position, the support plates of adjacent separators will take up the swaying motion of the railroad cars, thus, preventing the shifting of the racks with the sheet metal stampings loaded thereon.

Having, thus, described the invention, what is claimed is:

1. In an impact panel separator for a railroad car rack, the separator being of the type having a projecting linear member, the linear member having a plurality of notches formed therein, an improved notch engaging locking device therefor, comprising:

a plate having a keyway formed therethrough, the keyway being dimensioned to permit the translation of the plate over the linear member in a plane substantially perpendicular to the longitudinal axis of the linear member only when the keyway is oriented in a single direction, the direction being achieved by the rotation of the plate in the plane.

2. The improvement of claim 1 wherein the keyway is defined by a pair of spaced apart sidewalls, an arcuate top wall, and a base, the base having a recess formed therein.

3. The improvement of claim 2 wherein the distance between the top of the arcuate top wall and the base is less than the height of the linear member.

4. The improvement of claim 2 wherein the distance between the side walls of the keyway is slightly larger than that of the height of the linear member.

5. The improvement of claim 1 wherein the keyway is formed centrally of the plate.

6. The improvement of claim 1 wherein the plate has a thickness less than the width of any one notch.

7. The improvement of claim 1 wherein the keyway is disposed centrally of the plate and is defined by a pair of sidewalls, an arcuate top wall and a base, the base having a recess formed therein, and wherein the distance between the top of the arcuate top wall and the base is less than the height of the linear member and, the distance between the sidewalls of the keyway is slightly larger than the height of the linear member, such that the locking device can be translated over the linear member only when the sidewalls of the keyway overlie and underlie the linear member.

8. In an impact panel separator for a railroad car rack, the separator being of the type having a projecting linear member, the linear member having a plurality of notches formed therein, an improved notch engaging locking device therefor, comprising:

a plate having a keyway formed therethrough, the keyway being dimensioned to permit the translation of the plate over the linear member in a plane substantially vertical to the longitudinal axis of the linear member only when the keyway is oriented in a single direction by the rotation of the plate in the plane, and wherein the keyway is disposed centrally of the plate and is defined by a pair of sidewalls, an arcuate top wall and a base, the base having a recess formed therein, the distance between the top of the arcuate wall and the base being less than the height of the linear member, the distance between the sidewalls of the keyway being slightly larger than the height of the linear member such that the locking device can be translated over the linear member within the plane only when the plate is rotated in the plane wherein the sidewalls of the keyway overlie and underlie the linear member, and, the top wall seating in a notch when the locking device is in a locking position.

9. A notch engaging locking device for a linear, notched, impact panel separator, comprising:

a plate having a keyway formed therethrough, the keyway being disposed centrally of the plate and being defined by a pair of spaced apart sidewalls, an arcuate top wall and a base, the base having a recess formed therein, the keywall being dimensioned such that the distance between the arcuate top wall and the base is less than the height of the separator, the distance between the sidewalls of the keyway being slightly larger than the height of the separator, the arcuate top wall being adapted to seat within a notch of the separator, and wherein the locking device is translatable over the separator in a plane substantially perpendicular thereto and only when the locking device is rotated in the plane such that the sidewalls of the keyway overlie and underlie the separator.

* * * * *